US011298907B2

(12) United States Patent
Valterio

(10) Patent No.: US 11,298,907 B2
(45) Date of Patent: Apr. 12, 2022

(54) CREASING PLATE FOR CREASING A SHEET FROM PAPER, CARDBOARD, CARTON, FOIL OR A SIMILAR MATERIAL

(71) Applicant: BOBST MEX SA, Mex (CH)

(72) Inventor: Roberto Valterio, Ollon (CH)

(73) Assignee: BOBST MEX SA, Mex (CH)

( * ) Notice: Subject to any disclaimer, the term of this patent is extended or adjusted under 35 U.S.C. 154(b) by 129 days.

(21) Appl. No.: 16/627,560

(22) PCT Filed: Jun. 25, 2018

(86) PCT No.: PCT/EP2018/025172
§ 371 (c)(1),
(2) Date: Dec. 30, 2019

(87) PCT Pub. No.: WO2019/007553
PCT Pub. Date: Jan. 10, 2019

(65) Prior Publication Data

US 2020/0215782 A1 Jul. 9, 2020

(30) Foreign Application Priority Data

Jul. 6, 2017 (DE) ..... 202017104039.9

(51) Int. Cl.
*B31B 50/25* (2017.01)
*B31F 1/08* (2006.01)
*B31F 1/10* (2006.01)

(52) U.S. Cl.
CPC ..... *B31B 50/252* (2017.08); *B31B 50/256* (2017.08); *B31F 1/08* (2013.01); *B31F 1/10* (2013.01)

(58) Field of Classification Search
CPC ..... B31B 50/25; B31B 50/252; B31B 50/256; B31F 1/08; B31F 1/10
See application file for complete search history.

(56) References Cited

U.S. PATENT DOCUMENTS 2,330,572 A 9/1943 Frey et al.
2,765,716 A * 10/1956 Andersson ..... B31F 1/08 493/468
2,855,884 A * 10/1958 Magill ..... B31B 50/00 156/183

(Continued)

FOREIGN PATENT DOCUMENTS

CN 1069242 A 2/1993
CN 204712526 U 10/2015

(Continued)

OTHER PUBLICATIONS

International Search Report (2 pages) issued in related PCT/EP2018/025172, dated Oct. 12, 2018.

*Primary Examiner* — Andrew M Tecco
*Assistant Examiner* — Nicholas E Igbokwe
(74) *Attorney, Agent, or Firm* — Bookoff McAndrews, PLLC

(57) ABSTRACT

A creasing plate (24) for creasing a sheet (12) from paper, cardboard, carton, foil or a similar material, the creasing plate (24) consisting of plastically deformable material and comprising at least one creasing projection (26) formed from a plurality of small, plastically deformed areas which merge into each other so as to form the creasing projection (26).

20 Claims, 19 Drawing Sheets

(56) References Cited

U.S. PATENT DOCUMENTS

Figure 1:
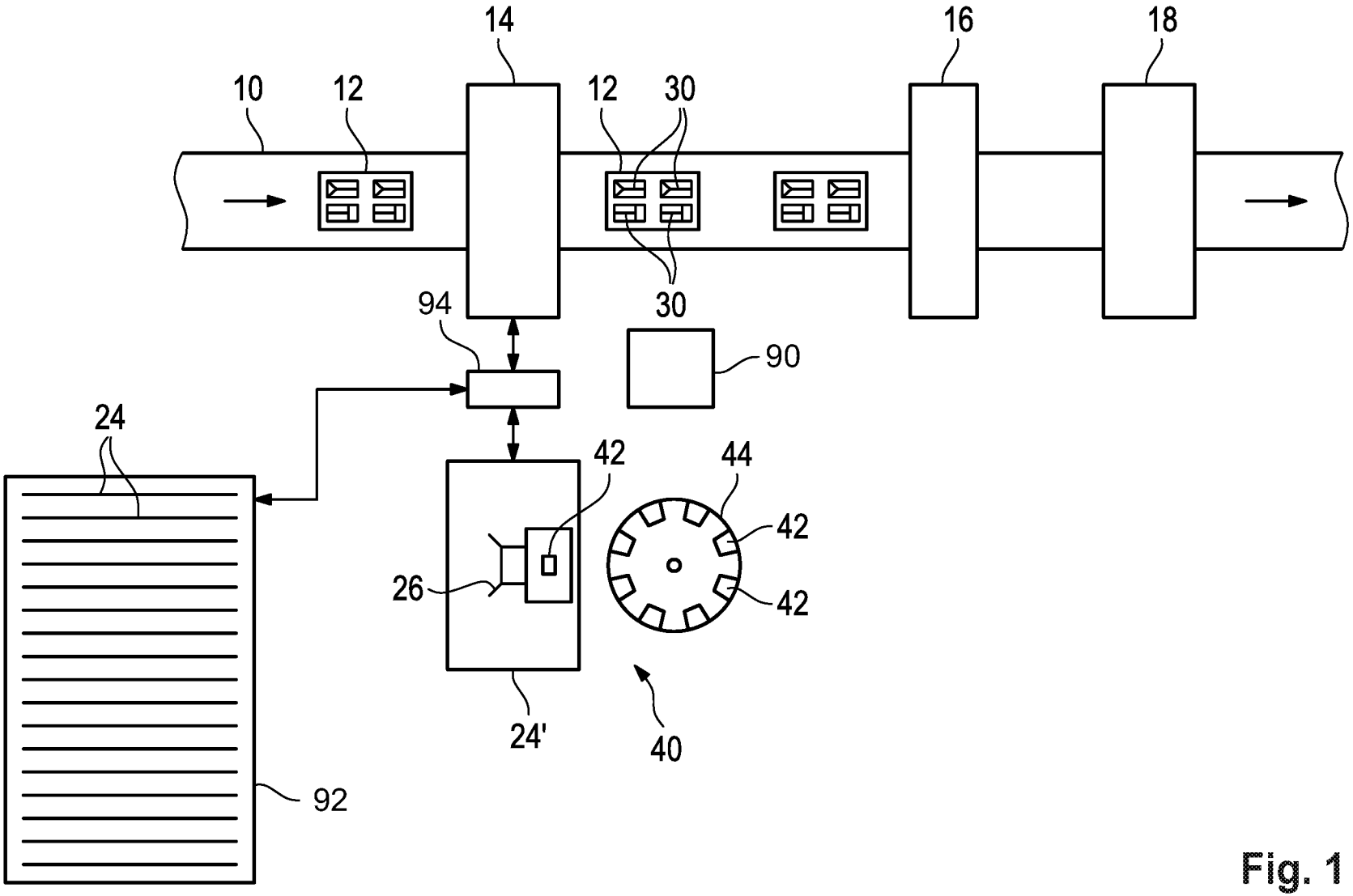

| | | | | | |
|---|---|---|---|---|---|
| 4,289,492 | A * | 9/1981 | Simpson | B31F 1/10 | 493/371 |
| 4,711,797 | A * | 12/1987 | Niske | B24B 1/00 | 428/34.2 |
| 5,054,389 | A | 10/1991 | Kuhlman | | |
| 5,275,075 | A | 1/1994 | Keech | | |
| 5,888,183 | A * | 3/1999 | Ruthenberg | B31F 1/10 | 493/366 |
| 6,446,858 | B1 * | 9/2002 | Louman | B65D 5/4266 | 229/5.82 |
| 6,508,751 | B1 * | 1/2003 | Weishew | B31B 50/00 | 493/160 |

FOREIGN PATENT DOCUMENTS

| | | | |
|---|---|---|---|
| CN | 105189061 | A | 12/2015 |
| DE | 10 39 016 | B | 9/1958 |
| DE | 1789849 | U | 6/1959 |
| DE | 10062294 | A1 | 6/2002 |
| DE | 102008025221 | A1 | 12/2009 |
| JP | S5933034 | A | 2/1984 |
| JP | 2000289124 | A | 10/2000 |
| JP | 2004148763 | A | 5/2004 |
| JP | 2015229322 | A | 12/2015 |
| WO | 2016169574 | A1 | 10/2016 |

* cited by examiner

CREASING PLATE FOR CREASING A SHEET FROM PAPER, CARDBOARD, CARTON, FOIL OR A SIMILAR MATERIAL

This application is a National Stage under 35 U.S.C. § 371 of International Application No. PCT/EP2018/025172, filed on Jun. 25, 2018, which claims priority to German Utility Model Application No. 202017104039.9, filed Jul. 6, 2017, the contents of all of which are incorporated by reference in their entirety.

The invention relates to creasing plate for creasing a sheet from paper, cardboard, carton, foil or a similar material.

Creasing machines are used for generating one or more creases in a sheet from which blanks are cut which are folded. Each of the creases forms kind of a "hinge" which allows the later formed blanks to be folded at a well-defined place.

The creasing machine can be formed as a device or system which is either a standalone unit or is integrated into a larger machine or system such as a printing machine or a finishing machine.

The sheets can be made from cardboard, carton or a foil, and they can be provided to the creasing machine separately or in a continuous manner as part of a web.

The creases are formed by locally applying a pressure onto the sheet. To this end, creasing knives are known which are pressed onto the surface of the sheet so as to generate the crease. It is also known to provide local projections on the creasing tool, for example by etching away those portions of the creasing tool which shall not project, or by locally applying a plastic material in a liquid condition, which is then cured.

The creasing tool can either be generally flat and be moved back and forth in a direction which is generally perpendicular with respect to the plane in which the sheet extends, or it can be generally cylindrical and be rotated so as to engage at the sheet when it is being transferred through the creasing area.

The problem with all creasing machines is that they can hardly be quickly adapted to a specific pattern of creases to be applied to a sheet. This has become more of a problem since digital printing allows changing very quickly from one printing job to a different one.

Assuming that the creasing tool is to be manufactured by means of an etching process, it may take several hours until a new creasing tool is available. Assuming that the creasing projections are formed by applying a plastic material to a carrier, the manufacturing times might be shorter, depending on the time which is necessary for curing the plastic material. However, the lifetime of such a creasing tool is significantly shorter than the lifetime of a creasing tool comprising an etched steel plate. In any case, the step of adapting the creasing machine to a new creasing job is the bottleneck when the creasing machine is used in connection with a digital printing machine.

The object of the invention is to provide a means for being able to make a creasing machine quickly ready of a new creasing job.

This object is achieved with a creasing plate for creasing a sheet from paper, cardboard, carton, foil or a similar material, the creasing plate consisting of a deformable material and comprising at least one creasing projection formed from a plurality of small, plastically deformed areas which merge into each other so as to form the creasing projection.

The invention is based on the concept of using a creasing plate in which the creasing projection is formed by a large number of punching strokes, the individual punching strokes generating the creasing projection. This allows achieving two advantages. First, the creasing plate has a long lifetime as there is very little wear at the creasing projections, simply because they are made from a durable material, for example from metal. The strain hardening which inevitably occurs during punching contributes to the wear resistance of the creasing plate. Second, individual creasing plates can be manufactured quickly and with very little effort by for example a turret punching machine or a coil punching machine.

The creasing plate can have a thickness in the range of 0.2 to 0.6 mm. Sheet materials such as metal with this thickness on the one hand has a sufficient strength for achieving a long lifetime while it on the other hand does not require excessive punching forces.

Preferably, the creasing plate is made from carbon steel or stainless steel. This material is advantageous as regards its mechanical strength and also in that no problems with corrosion can occur.

The creasing projection can have a height in the order of 0.6 to 1.6 mm. More preferably, a value of approx. 1.2 mm can be used, even though this depends from the material to be creased. The value of 1.2 mm has proven to achieve good results for carton.

At its apex, the creasing projection can have a radius of 0.2 to 0.8 mm, more preferably in the order of 0.35 to 0.55 mm. These values have shown to be a good compromise between sharp, well defined creases on the one hand and a low risk of breaking or otherwise damaging the material of the creasing plate during the manufacturing process on the other hand.

Preferably, the creasing projection has, in a cross section, a width at its base in the order of 1 to 3 mm, preferable approximately 2 mm. The width has an important influence on the crease and is preferably chosen to be smaller for thinner material while a larger width is used for creasing thicker material such as corrugated cardboard.

According to a preferred embodiment, the creasing plate is a curved plate having a first clamping area at a forward end and a second clamping area at a rearward end. Such creasing plate can be very quickly and reliably clamped to a creasing cylinder.

According to an embodiment of the invention, a driving fillet is provided on the creasing plate, the driving fillet extending around the majority of the circumference of the creasing cylinder. The driving fillet is chosen regarding its height such that it exerts a constant driving force on the sheets advanced through the creasing area between the cylinders, ensuring that the sheets are properly driven irrespective of the creasing projections on the creasing plate.

Depending from the requirements, the driving fillet may be formed by one substantially continuous fillet or in the alternative by a plurality of substantially discontinuous fillets.

If a plurality of substantially discontinuous fillets is being used, these are preferably aligned in the circumferential direction so as to constantly interact with the sheet.

It is also possible to have the plurality of substantially discontinuous fillets orientated at an angle or at more than one angle to the circumferential direction.

The driving fillet can be formed by a plastically deformed portion of the creasing plate in a manner similar to the creasing projections, or can be generated by adding a strip of material onto the creasing plate, e.g. from an epoxy material. This adds flexibility as the suitable height, widths and location of the driving fillet can be set for each new creasing job and the creasing plate used therefore.

According to a preferred embodiment, at least two straight creasing projections are provided, the creasing projections extending terminating in a distance from each other which is less than 3 mm. This small distance between adjacent creasing projections ensures that only very little uncreased material remains between the creases, thereby ensuring that the folds are of good quality.

Preferably, the creasing projections extend at an angle of 15° to 90° with respect to each other, giving full flexibility regarding the creases to be generated on the sheets.

According to a preferred embodiment, the creasing projections merge with the remainder of the creasing plate according to a radius which is in the order of 0.2 to 17 mm. A short radius is advantageous for being able to have creases terminating at a short distance to each other while a large radius is advantageous for achieving a smooth transition from the deformed material to the undeformed material of the creasing plate.

The creasing plate preferably consists of sheet metal. Thus, the desired properties such as the ability to be plastically deformed and to have a high wear resistance, are obtained at low costs.

Other materials, in particular non-metallic material such as a polymeric material, can however also be used for manufacturing the creasing plate.

Figure 2:
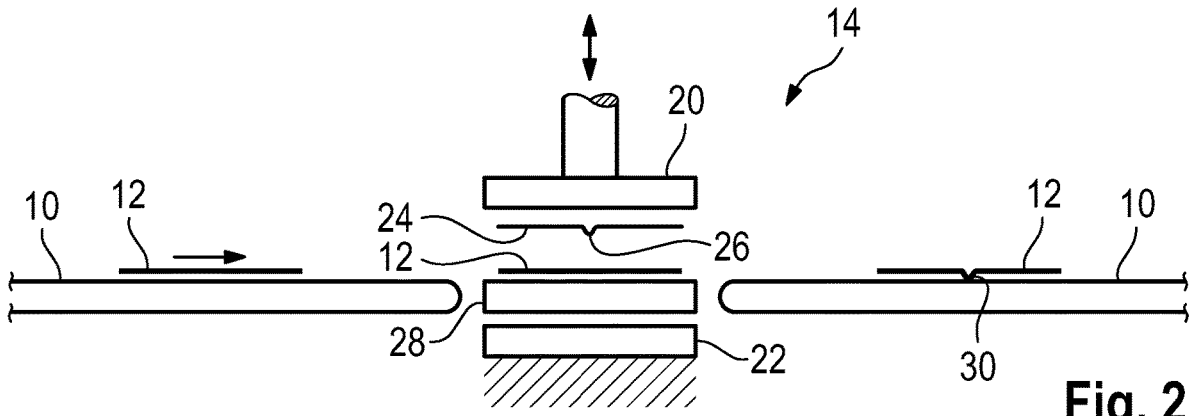
Figure 3:
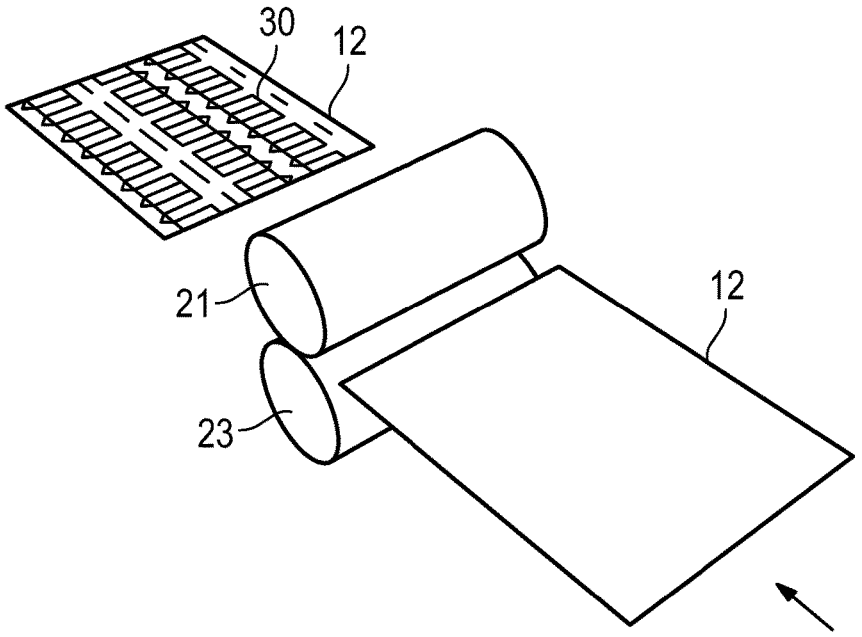
Figure 4:
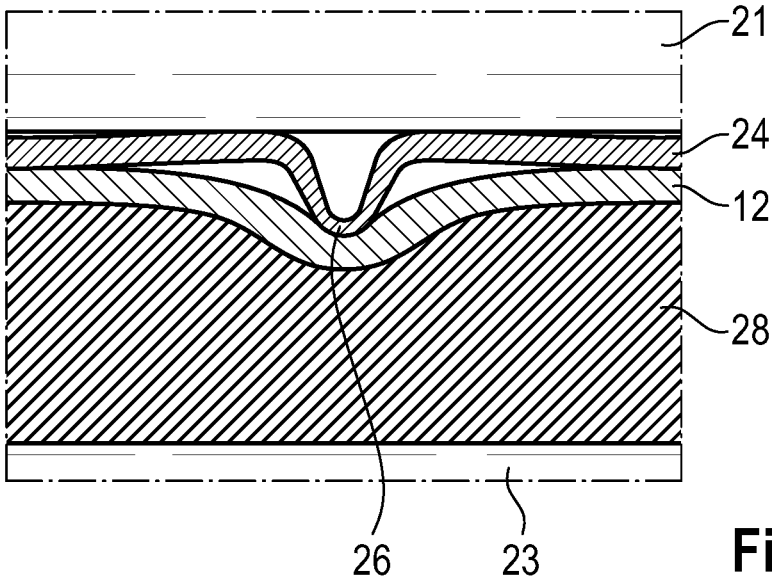
Figure 5:
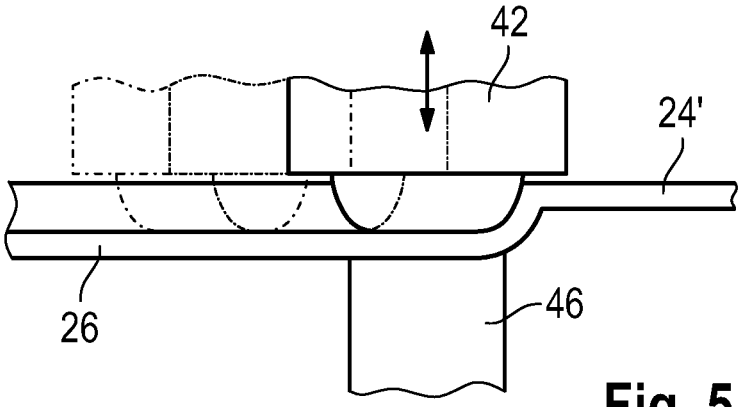
Figure 6A:
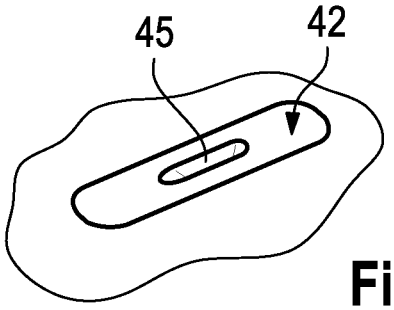
Figure 6B:
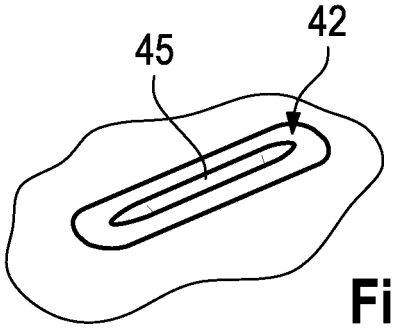
Figure 6C:
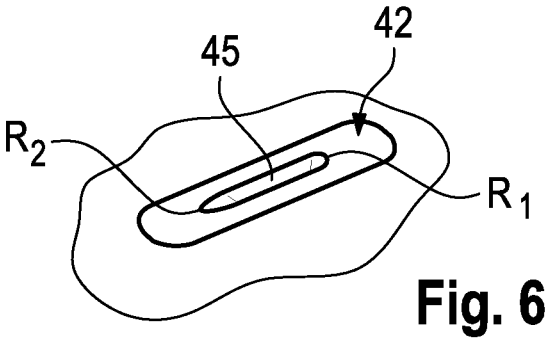
Figure 7A:
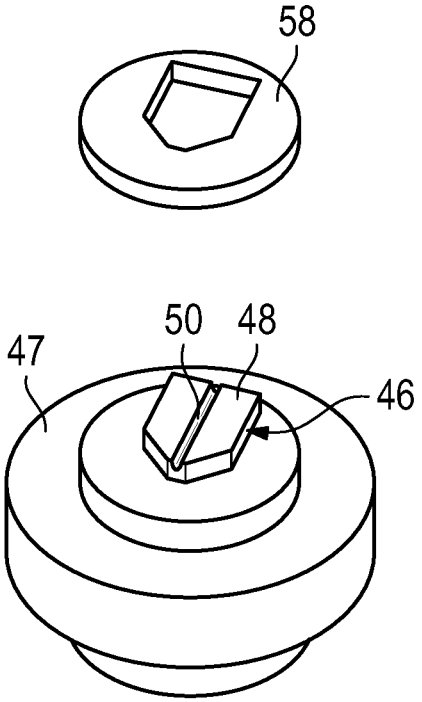
Figure 7B:
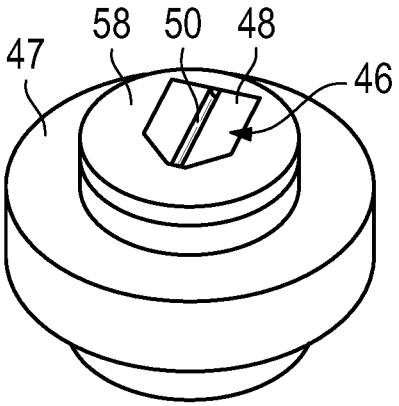
Figure 8:
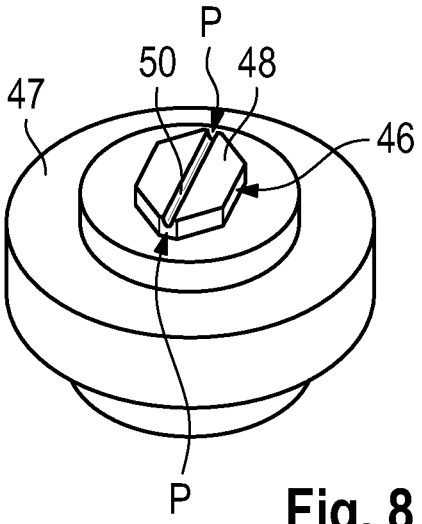
Figure 9:
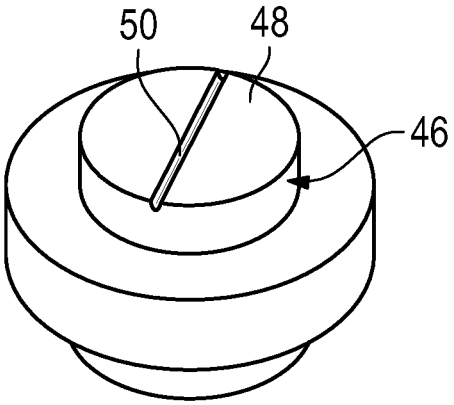
Figure 10:
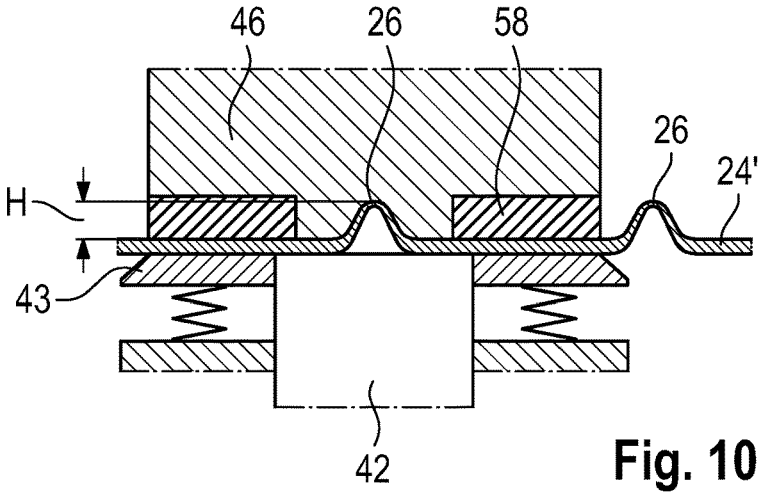
Figure 11A:
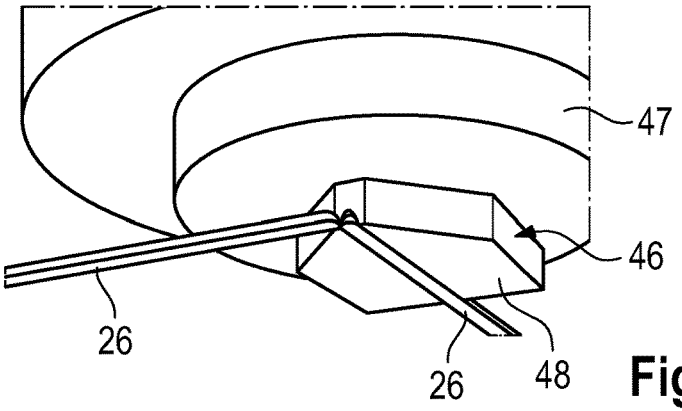
Figure 11B:
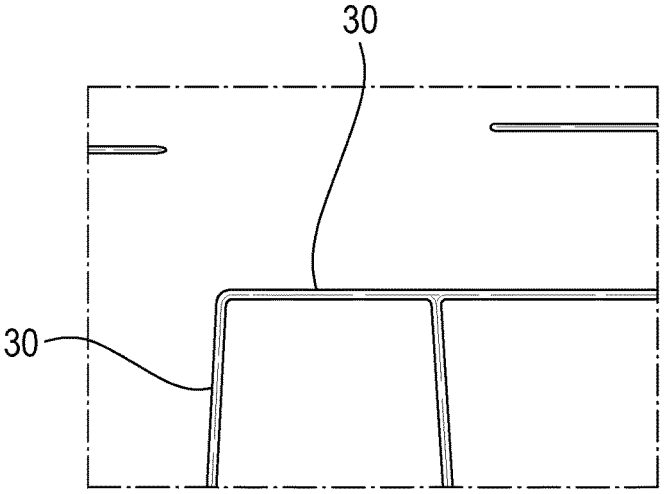
Figure 12A:
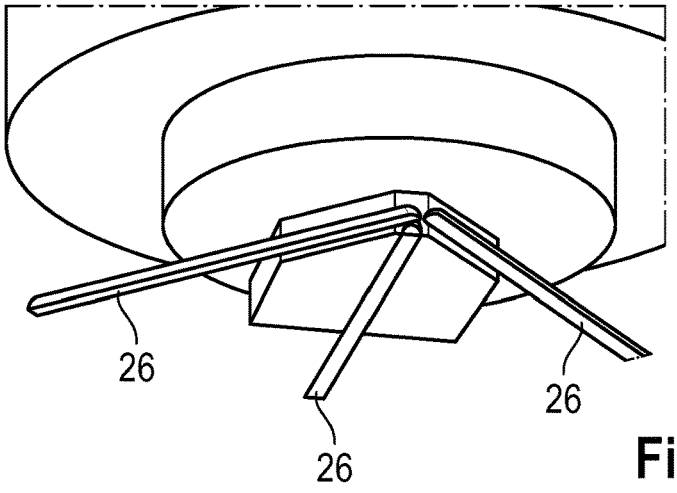
Figure 12B:
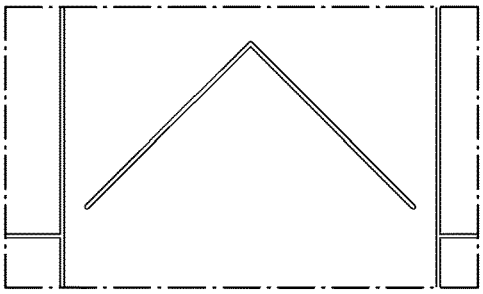
Figure 12C:
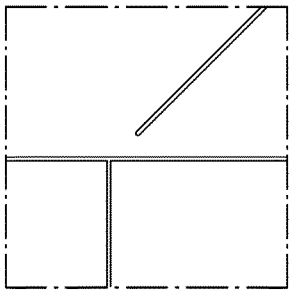
Figure 12D:
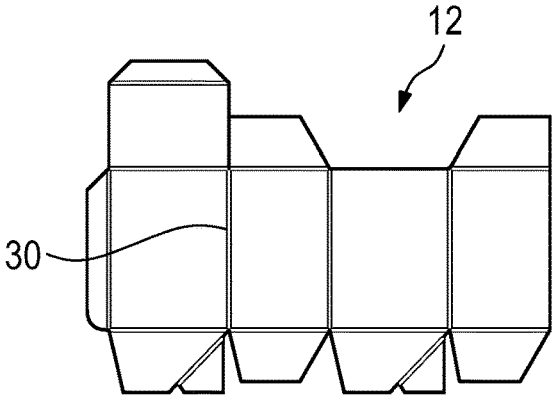
Figure 12E:
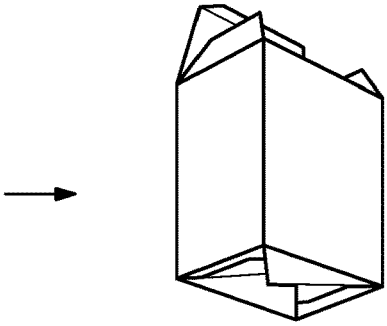
Figure 13A:
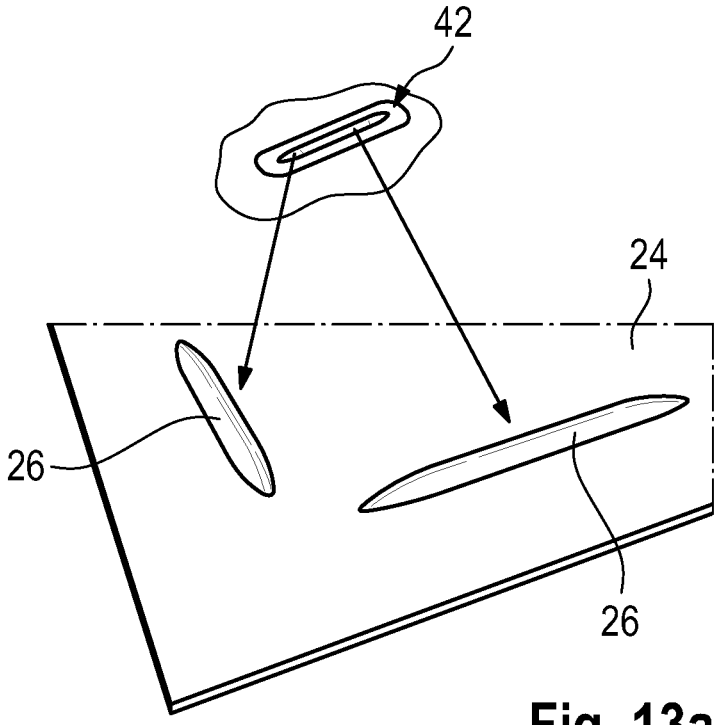
Figure 13B:
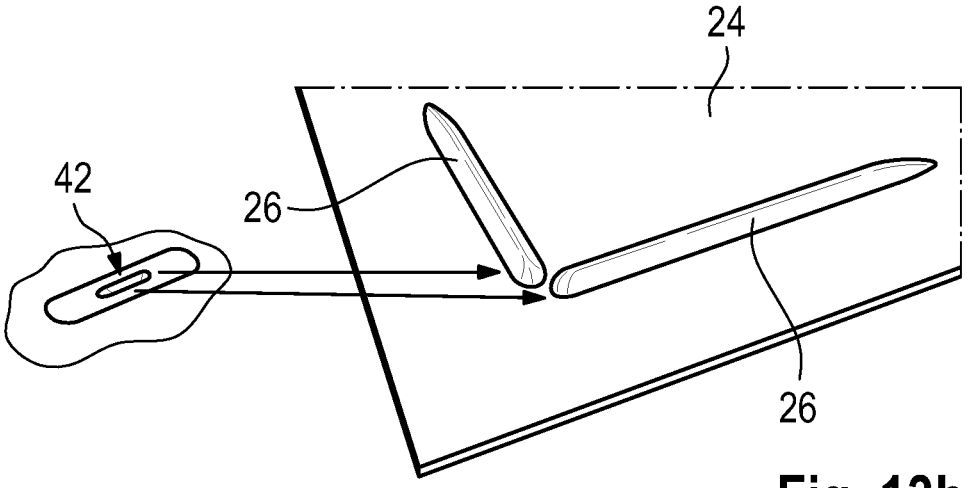
Figure 15A:
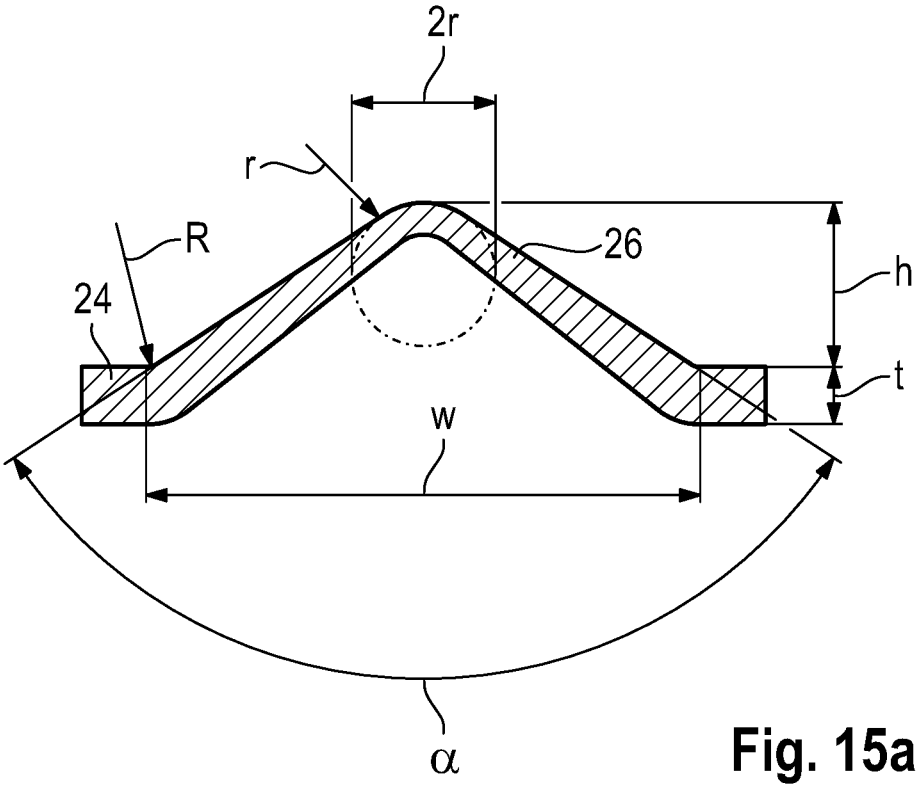
Figure 15B:
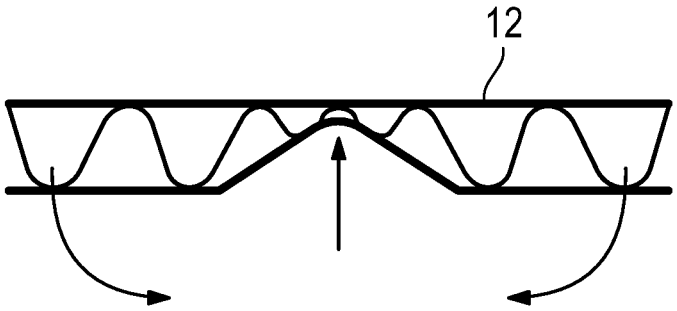
Figure 16B:
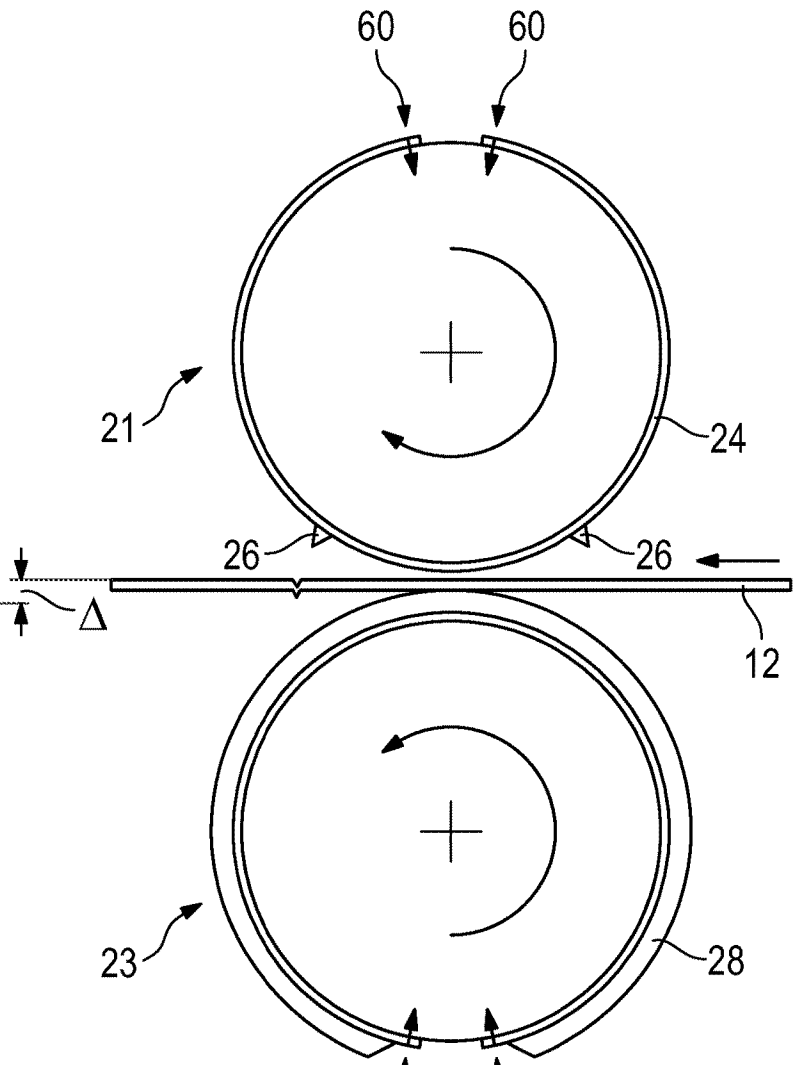
Figure 16A:
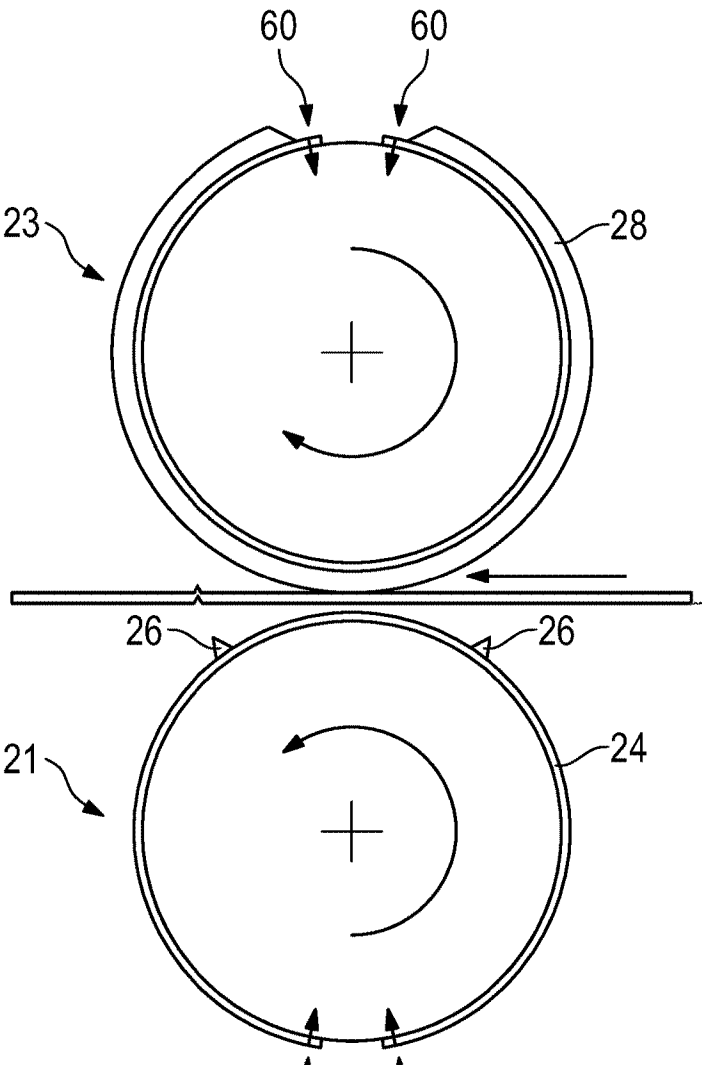
Figure 17:
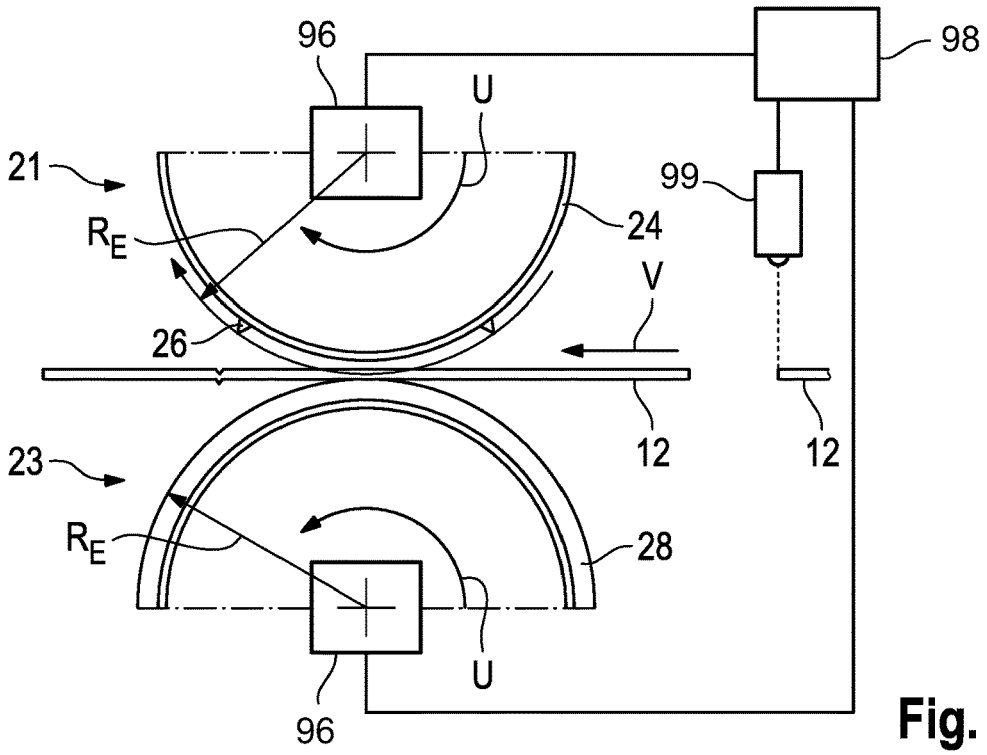
Figure 18:
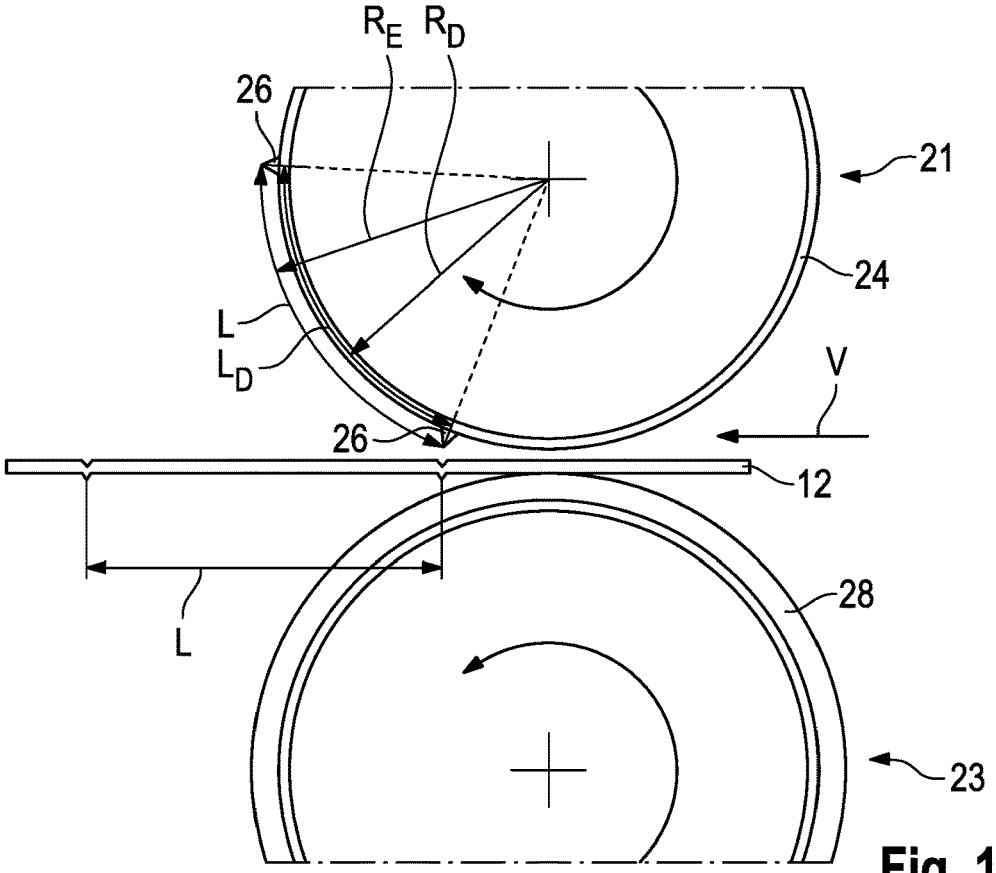
Figure 19:
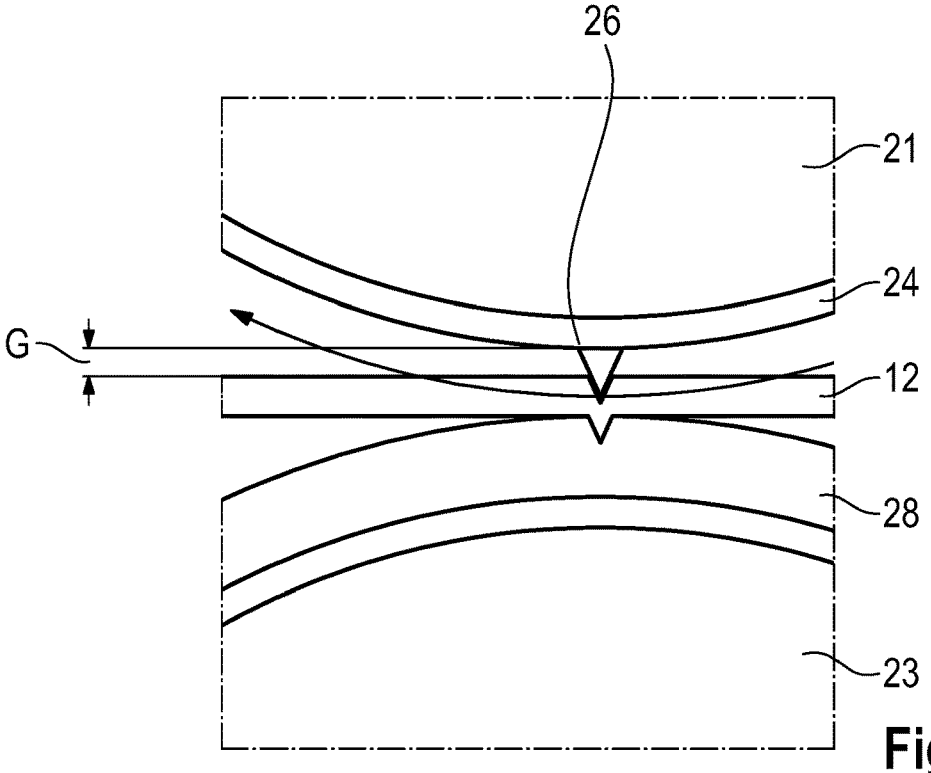
Figure 20A:
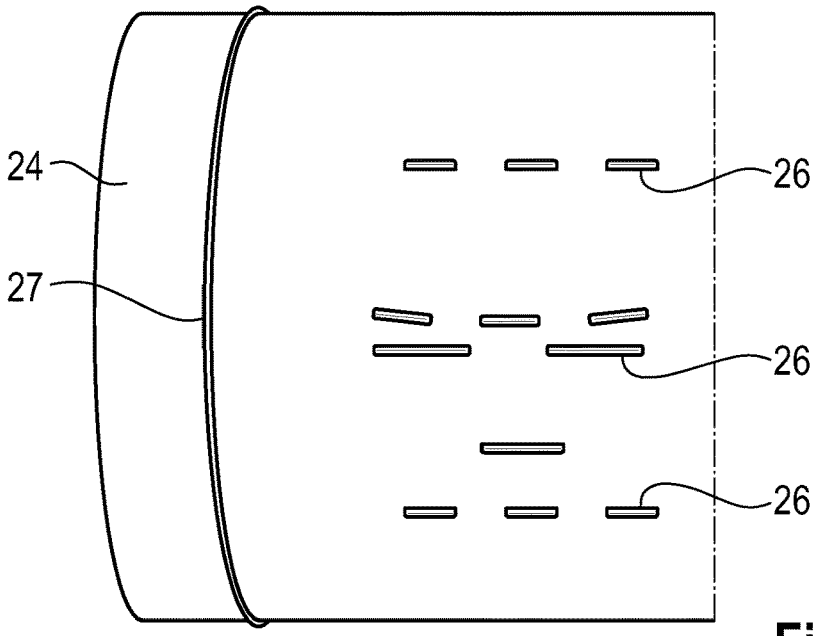
Figure 20B:
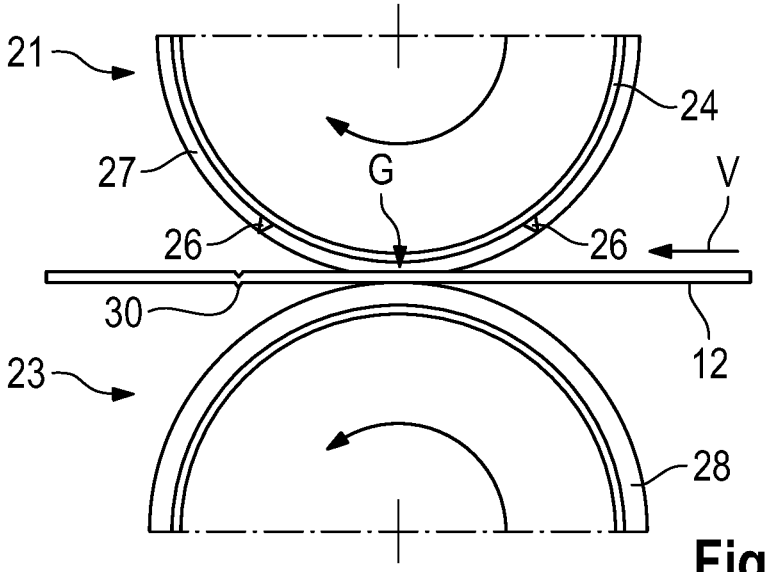
Figure 20C:
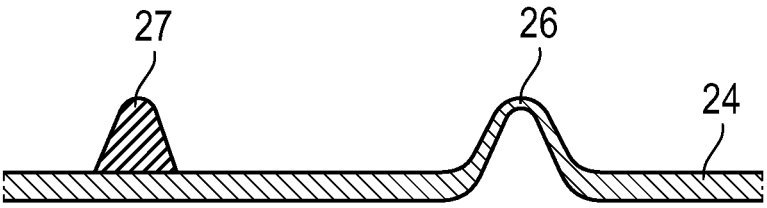
Figure 21A:
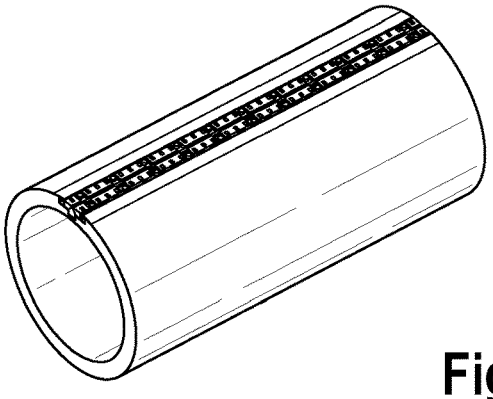
Figure 21B:
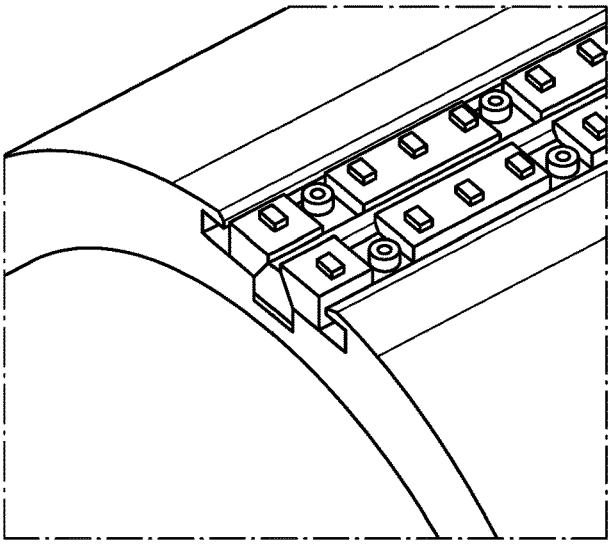
Figure 21C:
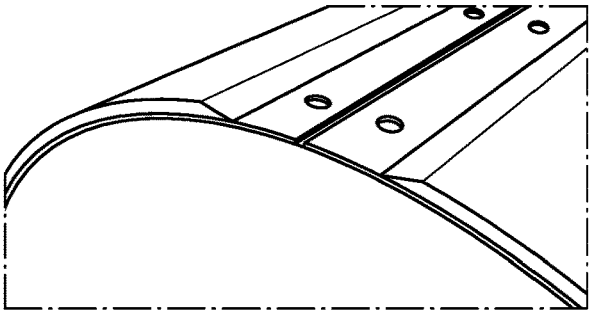

The invention will now be described with reference to the enclosed drawings. In the drawings, FIG. 1 schematically shows a creasing machine, FIG. 2 schematically shows one embodiment of the creasing tool used in the creasing machine of FIG. 1, FIG. 3 schematically shows a second embodiment of a creasing tool used in the creasing machine of FIG. 1, FIG. 4 shows a cross section through a creasing plate mounted to the creasing tool and generating a folding crease by pressing the sheet against the counter element, FIG. 5 schematically shows the process of creating a creasing projection on a creasing plate, FIGS. 6*a* to 6*c* show three different embodiments of punches used in the creasing machine of FIG. 1, FIGS. 7*a* and 7*b* show a first embodiment of a die used in the creasing machine of FIG. 1, FIG. 8 shows a second embodiment of the die used in the creasing machine of FIG. 1, FIG. 9 shows a die according to the prior art, FIG. 10 shows a cross section through a punch and a die when deforming a creasing plate blank, FIGS. 11*a* and 11*b* schematically show the die of FIGS. 7*a* and 7*b* when generating two merging creasing projections, and the folding creases generated with these folding projections, and FIGS. 12*a* to 12*e* schematically show the die of FIGS. 7*a* and 7*b* used for manufacturing three merging folding projections, and the folding creases generated with these creasing projections as well as a corresponding blank cut from a sheet and a box manufactured from the blank, FIGS. 13*a* and 13*b* show in more detail creasing projections obtained with the punches of FIGS. 6*b* and 6*c*, FIGS. 14*a* and 14*b* show a cross section through creasing projections used for creasing carton, FIGS. 15*a* and 15*b* show in a cross section a creasing projection used for creasing corrugated carton and the crease obtained therewith, FIGS. 16*a* and 16*b* show the creasing tool of FIG. 3 in a first and in a second condition, FIG. 17 schematically shows the creasing tool in more detail in combination with a control of the speed of rotation of the cylinders, FIG. 18 shows a schematic cross section through the creasing tool for explaining the speed of rotation of the cylinders, FIG. 19 shows at a larger scale the area of contact between the two cylinders of the creasing tool and the sheet to be provided with the creases, FIGS. 20*a* to 20*c* show a top view on a creasing plate, a cross section through the creasing tool provided with a driving fillet and a cross section through part of a creasing plate provided with a driving fillet and a creasing projections, FIGS. 21*a* to 21*c* show a perspective view of a cylinder used in the creasing tool, an enlarged view of the clamping mechanism used for clamping the creasing plate and used for clamping the elastic layer of the counter cylinder, FIGS. 22*a* to 22*g* show different steps of using a counter cylinder according to an alternative embodiment, FIGS. 23*a* to 23*d* show the cylinder used in the creasing tool in more detail, and FIGS. 24*a* and 24*b* show the counter cylinder in more detail.

In FIG. 1, a creasing machine is schematically shown. It comprises a transportation system 10 for advancing sheets 12 through a creasing area 14 where folding creases can be applied to the sheets 12.

Additional processing stations 16, 18 may be provided as part of the creasing machine or associated therewith. Processing stations 16, 18 can be used for cutting, folding, gluing or otherwise processing the sheets 12 or articles produced therewith.

Sheets 12 can be made from cardboard, carton or foil, and they can later be processed so as to cut blanks from the sheets to form a package, a box, a wrapping, an envelope or a similar product.

Sheets 12 can be supplied to creasing area 14 either separately as shown in the Figure, or in the form of a continuous web guided through creasing area 14.

It is also possible to integrate into creasing area 14 a cutting system which allows separating the individual blanks from the sheet.

In creasing area 14, a creasing tool and a counter element cooperate so as to apply at least one folding crease to sheet 12. To this end, the creasing tool carries a creasing plate, the creasing plate being provided with creasing projections. The geometry and arrangement of the creasing projections on the creasing plate corresponds to the folding creases to be applied to the sheet.

A first example of the creasing tool and the counter element used in creasing area 14 is shown in FIG. 2.

The creasing tool is here in the form of a plunger 20 which can be advanced towards and pressed against a counter element 22. At plunger 20, a creasing plate 24 is mounted which is provided with at least one creasing projection 26. Only a single creasing projection 26 is shown here for increased clarity.

On the side facing plunger 20, counter element 22 is provided with an elastic layer 28 which preferably is formed from rubber or an elastomer.

The sheets 12 to be provided with a folding crease are advanced with transportation system 10 so as to be positioned between plunger 20 and counter element 22. Plunger 20 is then pressed against elastic layer 28 whereby creasing projection 26 creates a folding crease 30 by locally deforming sheet 12.

A second embodiment of the creasing tool and the counter element is shown in FIG. 3. Here, the creasing tool is provided in the form of a creasing cylinder 21, and the counter element is in the form of a counter cylinder 23. Accordingly, creasing plate 24 is curved, and elastic layer 28 is cylindrical.

The folding creases 30 are generated by advancing sheet 12 through the gap between creasing cylinder 21 and counter cylinder 23.

The interaction between creasing plate 24 and sheet 12 is shown in more detail in FIG. 4.

Creasing projections 26 are formed at creasing plate 24 by repeatedly and locally deforming the material of creasing plate 24 so as to generate the creasing projections 26 in the desired pattern. In order to allow for the desired plastic deformation, creasing plate 24 is formed from steel, in particular from carbon steel or stainless steel. It preferably has a thickness in the order of 0.2 to 0.6 mm.

For generating the creasing projections 26, a punching module 40 is provided, in particular a turret punching machine or a coil punching machine.

Punching machines of these types are generally known. They however are preferably slightly adapted for being used in combination with the creasing machine. In particular, punching module 40 may not be as versatile and powerful as a conventional punching machine as it only has to perform a very limited number of different operations (namely generating generally straight creasing projections) in a rather thin material.

Punching module 40 is schematically shown in FIG. 1 with a punch 42 used for plastically deforming a creasing plate blank 24'.

Further, punching module 40 comprises a turret 44 in which a plurality of different punches 42 is stored.

FIG. 5 schematically shows how punching module 40 generates a creasing projection 26 by repeatedly plastically deforming creasing plate blank 24'. With full lines, punch 42 is shown which cooperates with a die 46 positioned on the opposite side of creasing plate blank 24'. With dashed lines, the position of punch 42 during the previous punching stroke is shown, and dotted lines indicate the position of punch 42 during the again proceeding punching stroke.

Each stroke generates a small, plastically deformed area at the creasing plate blank 24', with the entirety of the plastically deformed areas forming the creasing projection (s) 26.

FIGS. 6*a* to 6*c* show different embodiments of the punch arranged on a carrier 43.

In FIG. 6*a*, a punch 42 with a comparatively short projecting portion 45 is shown. The length of the projecting portion can be in the order of one centimeter.

At its ends which are opposite each other when viewed along the longitudinal direction of the projecting portion 45, comparatively small radii are provided. They can be in the order of 0.2 to 2 millimeters.

In FIG. 6*b*, a punch 42 is shown in which the projection portion 45 is approximately three times the length of the projecting portion 45 of the punch 42 shown in FIG. 6*a*. It can be seen that the radii at the opposite ends of the projecting portion are comparatively large.

In FIG. 6*c*, a punch 42 is shown which has different radii at the opposite ends of the projecting portion 45. There is a small radius $R_1$ which is in the order of 0.2 to 2 millimeters only, and there is a large radius $R_2$ which can be in the order of 2 to 15 millimeters.

The height H (please see also FIG. 10) with which the projecting portion 45 projects over the forward end face of punch 42, is in the order to 1 to 2 mm.

FIGS. 7*a* and 7*b* show an embodiment of die 46 adapted for cooperating with punch 42 and mounted on a carrier 47.

Die 46 has a support surface 48 at which creasing plate blank 24' may abut during the punching operation. Within support surface 48, a recess 50 is provided. Recess 50 is sized so as to receive the plastically deformed material of creasing plate blank 24' forming the creasing projection 26.

As can be seen in FIGS. 7*a* and 7*b*, recess 50 is open at its opposite ends.

It can further be seen in FIG. 7*a* that the outer contour of die 46 adjacent one of the open ends of recess 50 extends inclined with respect to the longitudinal direction of recess 50. In particular, the outer contour at each side of recess 50 extends at an angle of 45° with respect to the longitudinal direction of recess 50.

At the opposite end of recess 50, the outer contour of die 46 extends perpendicularly with respect to the longitudinal direction of recess 50.

An elastic ejector 58 is arranged at die 46. Ejector 58 is formed as a plate from rubber or an elastomer and snugly surrounds die 46 so that it stays at the position shown in FIG. 7*b* without any additional measures.

In FIG. 8, a different embodiment of die 46 is shown. Here, die 46 has the inclined contour at both open ends of recess 50 (please see the portions to which arrows P point).

In FIG. 9, a conventional die 46 is shown which has a circular support surface 48.

In FIG. 10, a schematic cross section through the punch 42 cooperating with die 46 is shown.

The creasing plate blank 24' is held, during the process of locally plastically deforming it so as to create the creasing projections 26, between die 46 and the carrier 43. Carrier 43 is here spring loaded towards die 46 so as to act in the manner of a clamp.

This avoids tension in the creasing plate blank 24' which could result in unwanted deformations.

In FIGS. 11*a* and 11*b*, it is schematically shown how adjacent creasing projections 26 can be formed by means of the punch cooperating with die 46. For better clarity, the punch and the creasing plate are not shown in FIG. 11*a*. Rather, only creasing projections 26 formed at creasing plate 24 are shown.

The creasing projection 26 extending towards the left in FIG. 11*a* is a projection which was previously formed. The creasing projection 26 extending through the recess in die 46 is the creasing projection currently formed together with punch 42. It can be seen that the "new" creasing projection 26 can be formed to a point where it is immediately adjacent the "old" creasing projection 26.

The result of the immediately adjacent creasing projections 26 is visible in FIG. 11*b* where folding creases 30 are shown which are arranged at a 90° angle with respect to each other and which almost merge into each other. Since very little uncreased material remains in the corner between the folding creases 30, a very precise fold can be achieved in this area.

In FIGS. 12*a* to 12*e*, it is shown how three creasing projections 26 can be formed at a creasing plate. Due to the particular contour at one of the open ends of recess 50, the three creasing projections 26 can almost merge into each other at an intersection point. It can be seen in FIG. 12*d* where such creasing projections 26 can be used for forming folding creases 30 at a sheet 12.

These creasing projections are aimed to fold a composite flap of a crash lock bottom box or of a four corner or six corner tray.

Punching module 40 is capable of producing different creasing plates 24 by appropriately deforming a creasing plate blank 24' at the required locations. It is in particular possible for the creasing machine, in particular for a schematically shown control 90 of the creasing machine, to determine, upon receipt of data for a new creasing job, whether a new creasing plate 24 is to be manufactured or whether an "old" creasing plate used in a previous creasing job can be used. Depending on the determination, control 90 either initiates that punching module 40 manufactures a new creasing plate 24, or that the "old" creasing plate 24 is retrieved from an inventory 92 where the previously manufactured creasing plates 24 are being stored.

The creasing plate 24 (either newly manufactured or retrieved from inventory 92) is taken over by handling system 94 and is then mounted at the creasing tool.

If the creasing tool is a punch, the plate is mounted in a flat shape. If the creasing tool is a creasing cylinder, creasing plate 24 can be either bent and clamped to creasing cylinder 21, or a circumferentially closed creasing sleeve can be formed which can then be mounted to creasing cylinder 21.

As is explained above, a punch having larger radii at opposite sides (to be precise: having larger radii at opposite sides of its projecting portion 45) is used for obtaining creasing projections 26 which have a smooth transition between the material deformed with each stroke of the punch. FIG. 13*a* shows creasing projections 26 which terminate at a larger distance from each other. The creasing projections 26 very smoothly merge into the creasing plate 24.

FIG. 13*b* shows two creasing projections 26 which terminate in a very small distance from each other so as to almost merge into each other. These creasing projections 26 are obtained by using a punch 42 which has at least at its "forward" end (referring to the direction in which the creasing plate blank 24' is displaced during consecutive strokes) a small radius. The small radius allows for a comparatively steep rise of the creasing projection 26 from the creasing plate 24 so that a small distance between adjacent ends of the creasing projections 26 is possible.

It can be seen that the ends of the creasing projections which are at the opposite ends, terminate with a larger radius.

Figure 14A:
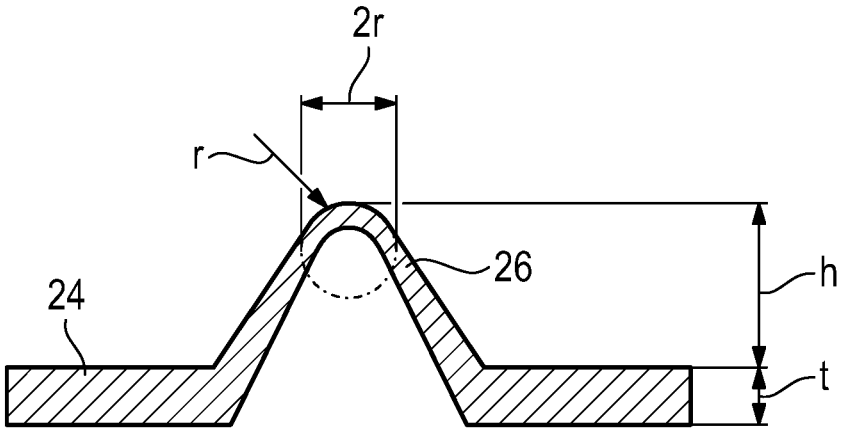
Figure 14B:
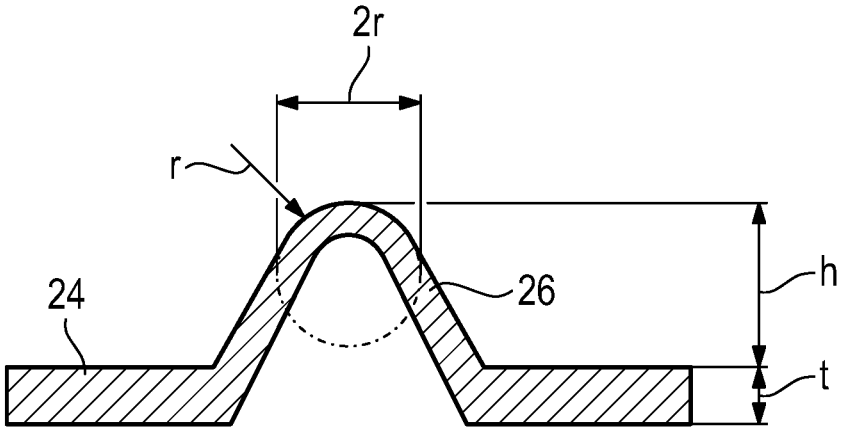

FIGS. 14*a* and 14*b* show cross sections through creasing projections 26 which have been proven to be very effective for creasing carton.

In FIG. 14*a*, the creasing plate has a thickness in the range of 0.4 mm while the height h of the creasing projection is in the range of 0.6 to 1.6 mm.

Depending from the particular carton to be creased, the radius rat the apex of the creasing projection 26 can be in the range of 0.25 to 0.7 mm. In other words, the apex matches an inscribed circle with a diameter of 2r.

Preferred values for the height h are in the region of 1.2 mm, while preferred radii can be 0.35 mm and 0.525 mm.

In FIG. 15*a*, a creasing projection 26 for creasing corrugated cardboard is shown. It can be seen that a much wider creasing projection is used as compared to the profiles shown in FIGS. 14*a* and 14*b*. In particular, the angle $\alpha$ is more than 90°. According to a preferred embodiment, this angle can be in the range of 110 to 120°, in particular 114°.

The wider conical shape of the profile of creasing projection 26 is effective to compress the carton on each side of the crease so as to create the space which is necessary for folding the corrugated cardboard (because of its increased thickness), thereby reducing the tension which is generated when the carton is folded.

Here again, a typical height of the creasing projection 26 is in the region of 1.2 mm. As the radius r at the apex of the profile, a value in the order of 0.5 to 0.6 mm is suitable, in particular 0.53 mm.

As a radius R at the base of creasing projection 26, a value in the order of 0.5 mm has been proven to be beneficial.

An inscribed circle here again can have a diameter of 1.05 mm.

It is important to note that the creasing projections 26 on one and the same creasing plate 24 can have different heights, depending from the particular requirements.

FIGS. 16*a* and 16*b* show an advantageous aspect of the creasing tool.

When changing from creasing cardboard to creasing corrugated carton, it is necessary to change the crease direction. This can very easily be done by changing the function of the two cylinders 21, 23.

In FIG. 16*a*, the upper cylinder acts as the counter cylinder 23 while the lower cylinder is the creasing cylinder 21. Accordingly, the elastic layer 28 is mounted to the upper cylinder while creasing plate 24 is mounted to the lower cylinder.

In the configuration shown in FIG. 16*b*, this arrangement is reversed. The elastic layer 28 is mounted to the lower cylinder while creasing plate 24 is mounted to the upper cylinder. Thus, the upper cylinder acts as creasing cylinder 21 while the lower cylinder acts as counter cylinder 23.

It is however the same set of cylinders which is being used. The function of the cylinder is simply determined by the "tool" mounted to it (either creasing plate 24 or elastic layer 28). Accordingly, both cylinders are provided with identical clamping mechanisms (here very briefly indicated with reference numeral 60), and the cylinders have the same diameter.

The functional outer radius of both cylinders depends from the tool mounted to it. In particular, the functional outer radius of the cylinder provided with the elastic layer 28 is larger than the functional radius of the cylinder provided with creasing plate 24. Accordingly, the plane in which sheet 12 is advanced through the creasing area between the cylinders has to be adjusted depending from the particular configuration. The respective Ais indicated between FIGS. 16*a* and 16*b*.

The vertical adjustment of the plane in which sheets 12 are provided can either be obtained by vertically adjusting the feeding device which advances the sheets, or by vertically adjusting the two cylinders 21, 23 with respect to the feeding plane.

Another consequence from the functional radius of the two cylinders being different is that the speed of rotation of the cylinders is slightly different as the tangential speed at the point of engagement at the sheets 12 has to be the same. Further, it has to match the speed with which the sheets 12 are advanced through the creasing tool.

In order to allow for an individual control of the speeds of rotation, each cylinder is provided with a servo motor 96 which is controlled by means of a machine control 64. Machine control 64 is also provided with a signal relating to the position of the clamping devices 60 as they form a dead zone where no creasing can be made.

Machine control 98 is furthermore provided with a signal relating to the position of the sheets 12 advanced through the creasing tool. This signal can be obtained via a sensor 99 which for example detects the leading edge of the sheets 12 upstream of the creasing tool.

Based on the effective radii $R_E$, the speed V with which the sheets 12 are advanced through the creasing tool, and the signal from sensor 99, machine control 98 suitably controls the servo motors 96 so as to achieve the proper speed of rotation U for each of the cylinders and also the correct position of the dead zone with respect to the individual sheets.

For manufacturing creasing plate 24, it has to be kept in mind that the creasing plate blanks 24' are deformed when being in a flat shape while the creasing plates are mounted, when installed on a creasing cylinder 21, in a curved shape. This results in the creasing projections 26 having, when the creasing plate is mounted to the creasing cylinder 21, a distance from each other which is larger than in the flat configuration of the creasing plate.

As can be seen in FIGS. 18 and 19, the creasing projections 26 are pressed into the carton to be creased by a certain distance (for example 1 mm) which however is less than the total height of the creasing projection. It is however preferred that the outer surface of creasing plate 24 does not touch the upper surface of sheets 12. Accordingly, a gap exists between the outer surface of creasing plate 24 and the upper surface of sheet 12.

FIG. 18 shows in an example the straight real length L between two creases 30, measured in parallel with the feeding direction of sheet 12. The same curved real length L can be measured between the apex of the corresponding creasing projections 26 on the functional, effective radius $R_E$. It can be seen that in a developed, flat condition of creasing plate 24, because of the difference between the development radius $R_D$ and the functional, effective radius $R_E$, the developed length Lo is less than the real length L. Accordingly, two creasing projections 26 have to be formed on the creasing plate 24 in a distance, parallel to the feeding direction, which is less than the actual distance which the respective creases shall have on sheet 12.

In FIGS. 20*a* and 20*b*, another aspect of the creasing tool is shown.

Typically, sheet 12 is driven between the creasing cylinder 21 and the counter cylinder 23 by the contact of the creasing projections 26 with the sheet and also because of the contact of the sheet with the counter cylinder. However, there are creasing configurations where at a certain point in time, no creasing projection 26 engages at sheet 12. Because of the gap G explained with reference to FIGS. 18 and 19, no proper driving force would be exerted onto sheet 12 in these points in time.

To ensure that sheet 12 is always positively driven irrespective of the particular position of creasing projections 26, a driving fillet 27 is provided which extends in a circular direction along the entire creasing plate 24. Driving fillet 27 can be a plastically deformed portion of creasing plate 24 in the same manner as the creasing projections 26.

It is however also possible to create driving fillet 27 in a different manner. As an example, an epoxy fillet could be added to the creasing plate in a separate manufacturing operation. Such driving fillet can be seen in FIG. 20*c*.

Driving fillet 27 does not have to project over the surface of creasing plate 24 in a manner which creates a distinct crease in sheet 12. The height can be chosen mainly in view of the intended driving force which shall be generated.

FIGS. 21*a* to 21*c* show the clamping mechanism 60 in more detail.

The clamping mechanism 60 is effective to anchor both ends of either creasing plate 24 or elastic layer 28 and force both ends towards each other equally. This ensures that the respective sleeve is correctly located around the cylinder. Further, this avoids problems with air pockets being trapped under the sleeve. Such air pockets could result in damage to the creasing plate 24 or the elastic layer 28 when the respective sleeve is put under pressure in operation.

FIGS. 22*a* to 22*g* show an additional aspect of the creasing machine.

In this embodiment, a sleeve of a shape memory material 29 is used on counter cylinder 23 instead of elastic layer 28. Shape memory material layer 29 is plastically deformed by means of creasing plate 24.

Figure 22A:
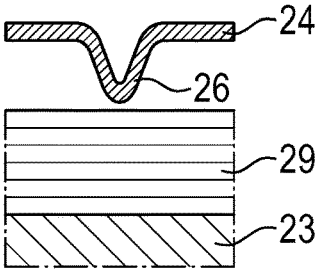

In FIG. 22*a*, creasing plate 24 has been mounted to creasing cylinder 21 while layer 29 having in a starting condition with a flat surface is mounted to counter cylinder 23.

Figure 22B:
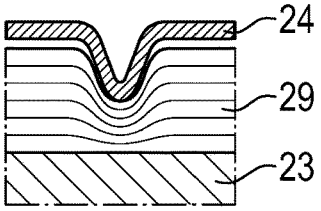

For shaping layer 29, the two cylinders 21, 23 are advanced towards each other so that creasing projections 26 on creasing plate 24 penetrate into layer 29 (please see FIG. 22*b*).

Figure 22C:
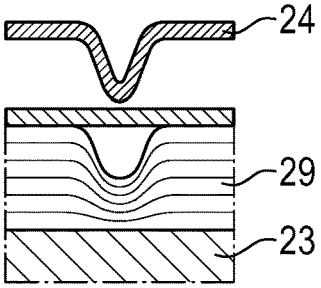

After increasing the distance between cylinders 21, 23 (and after curing, if necessary), layer 29 has the shape of a counter die to creasing plate 24 (please see FIG. 22*c*).

Figure 22D:
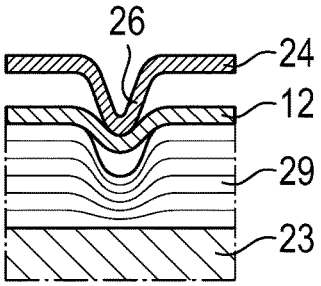
Figure 22E:
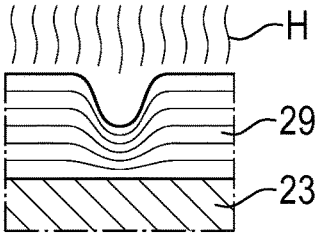
Figure 22F:
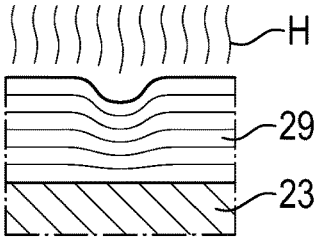
Figure 22G:
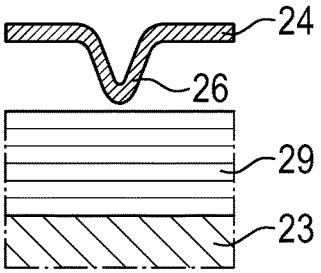

Subsequently, creasing cylinder 21 with creasing plate 24 and counter cylinder 23 with layer 29 can be used for creasing sheets 12 (please see FIG. 22*d*).

After a certain creasing job has been finished, layer 29 is restored to its original condition. To this end, layer 29 can be heated (schematically indicated with reference numeral H in FIGS. 22*e* and 220 so that the depressions in layer 29 are "erased".

When layer 29 has been restored to its original flat shape (please see FIG. 22*g*), the creasing machine is ready for the next creasing job which starts by creating a new counter die by deforming layer 29 with the new creasing plate 24.

Figure 23A:
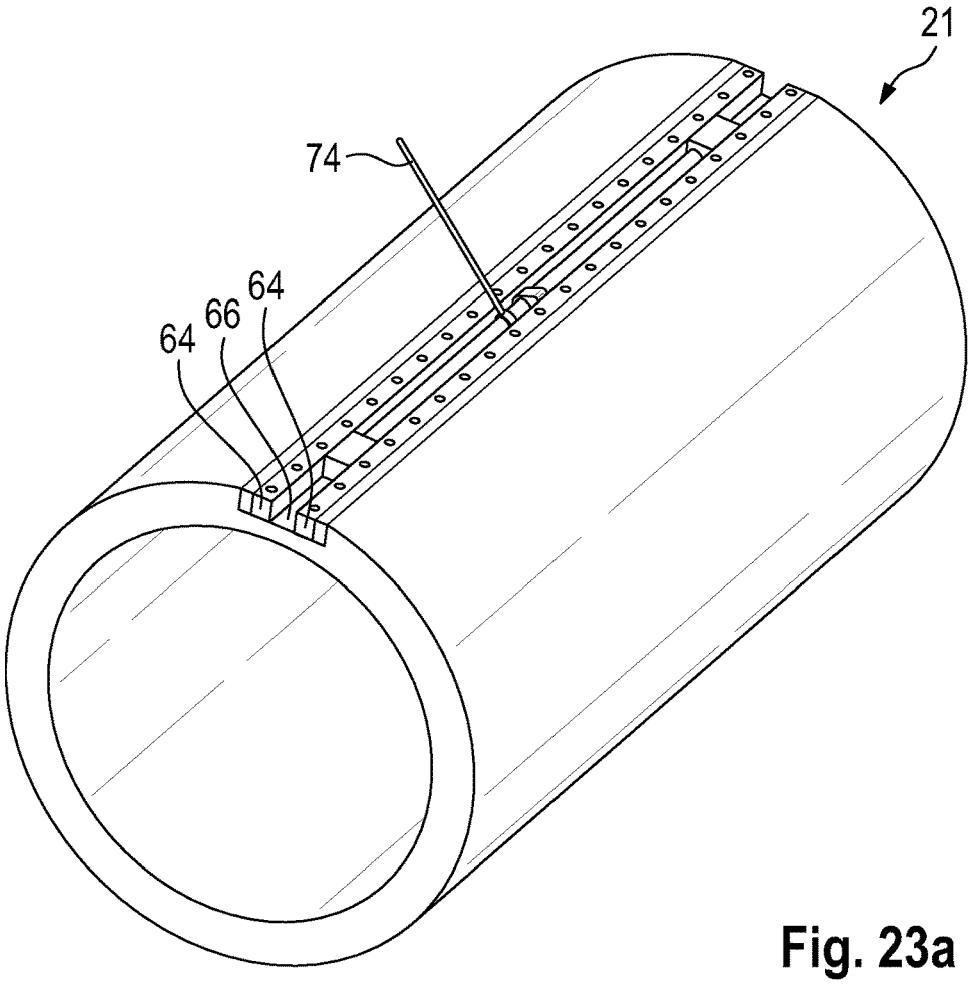
Figure 23B:
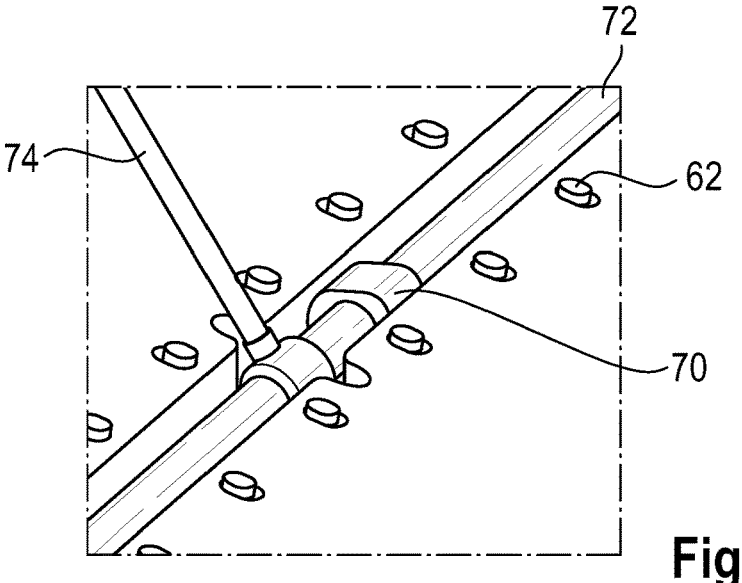
Figure 23C:
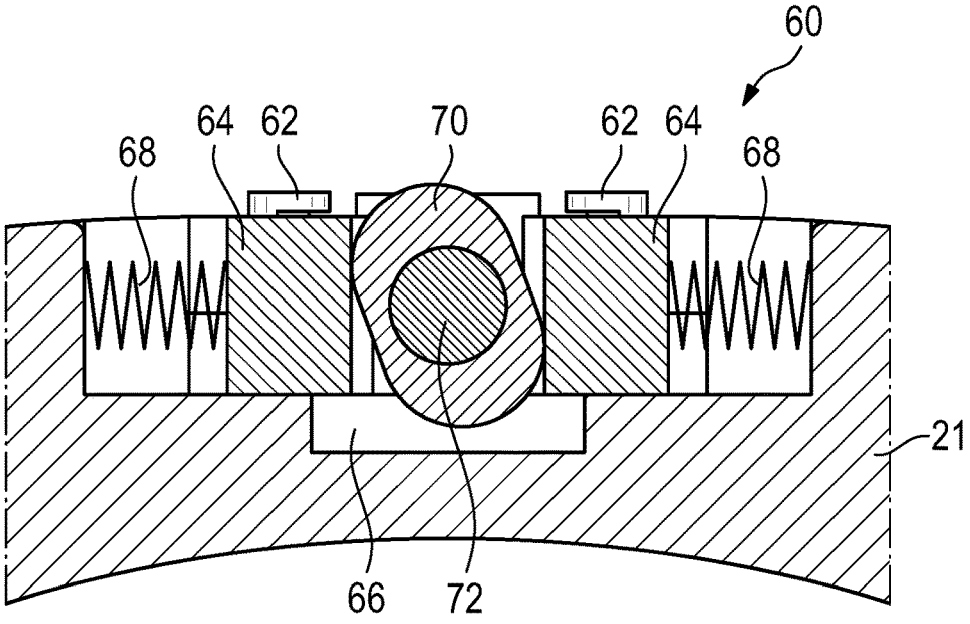
Figure 24A:
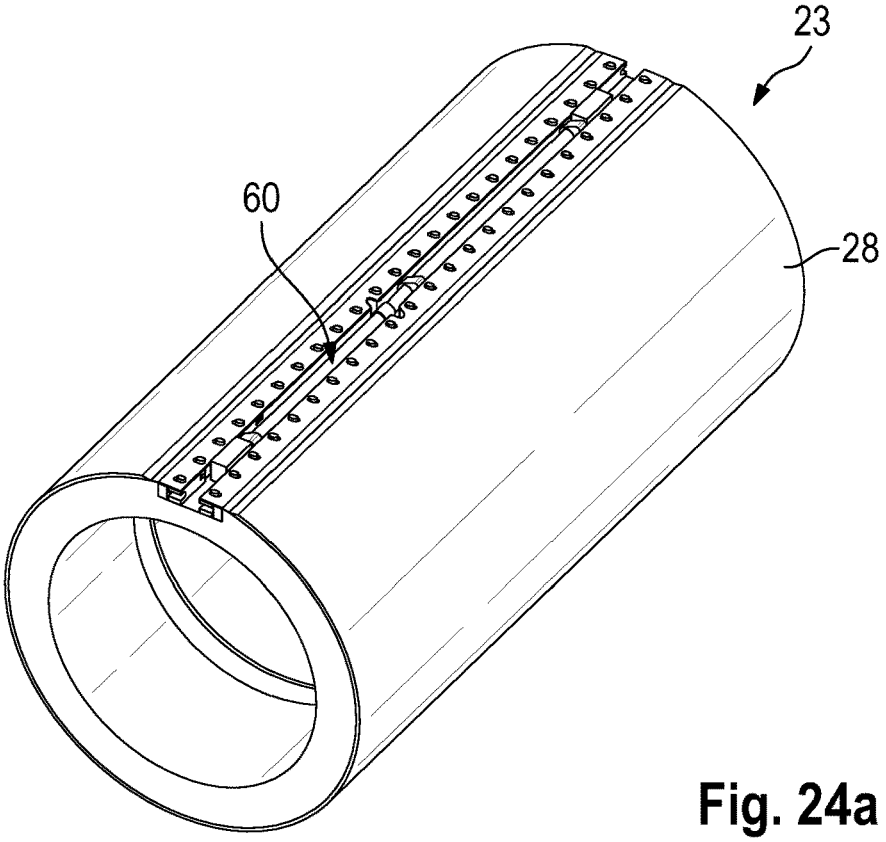
Figure 24B:
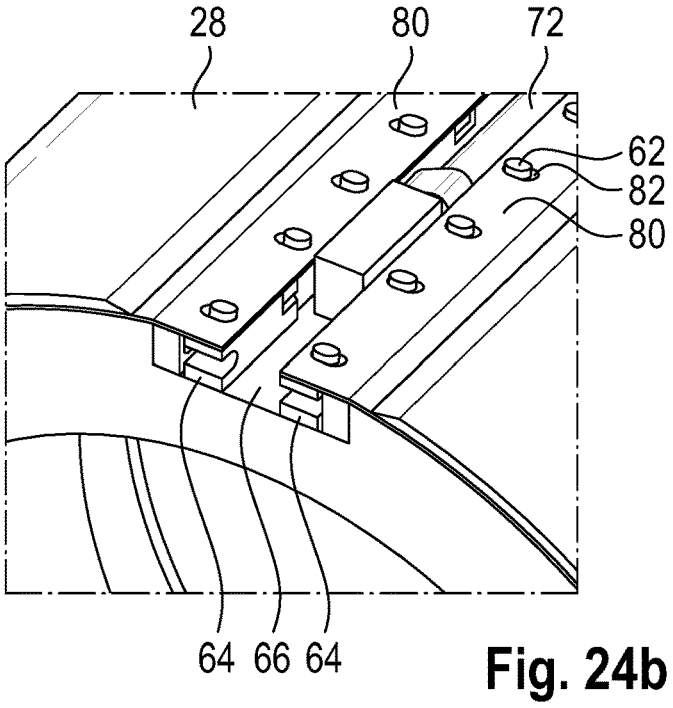

FIG. 23*a* shows the creasing cylinder 21 in more detail.

Figure 23D:
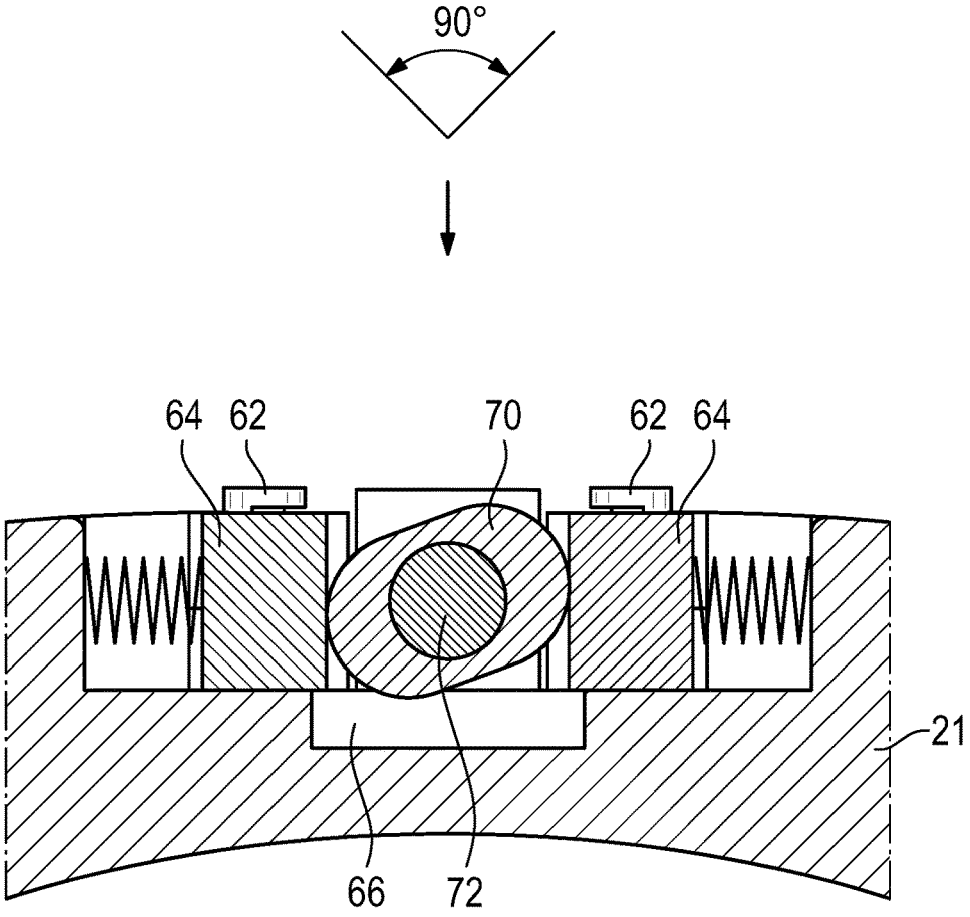

The clamping mechanism 60 has clamping pins 62 which are moveable between a clamping position (shown in FIG. 23*c*) and a release position (shown in FIG. 23*d*).

In the release position, the clamping pins 62 are spread apart as compared with the clamping position. Looking at FIGS. 23*c* and 23*d*, the distance between the clamping pins 62 in the clamping position is less than in the release position. In other words, a creasing plate 24 having holes into which the clamping pins 62 engage, is pulled to the outer circumference of the creasing cylinder when the clamping pins are in their clamping position.

The clamping pins 62 are mounted to sliding elements 64 which are arranged in a groove 66 formed in the creasing cylinder 21. The sliding elements 64 are biased by means of schematically shown springs 68 towards the center of the groove 66 and thus towards each other (and into the clamping position).

A release mechanism is provided for moving the clamping pins 62 from the clamping position into the release position. The release mechanism is here formed as a cam mechanism.

The cam mechanism has a plurality of cams 70 which are mounted non-rotatably on a shaft 72. The shaft is mounted rotatably in groove 66. Cams 70 are symmetrical with respect to the center of shaft 72. Thus, there are two apexes spaced by 180°.

Shaft 72 is provided with a bore for receiving an actuating tool 74 which can be a simple rod. The actuating tool 74 allows rotating the shaft and thus the cams 70 from the rest position shown in FIG. 23*c* to the spreading position shown in FIG. 23*d*.

In the rest position, the cams 70 do not exert notable forces on the sliding elements 64 so that they are urged by springs 68 towards each other into the clamping position.

In the spreading position, the cams urge the sliding elements 64 apart into the release position, against the force of the springs 68.

The amount of rotation of shaft 72 for transferring the cams 70 from the rest position into the spreading position is approx. 90°. It can be seen that in the spreading position, the cams 70 are moved "beyond" the dead center position in which the two apexes are arranged horizontally when looking at FIG. 23*d*, ensuring that the release mechanism reliably remains in the spreading position with the clamping pins 62 in the release position.

For mounting a creasing plate, the clamping pins 62 are brought into their release position. Then, the creasing plate is mounted at the creasing cylinder 21 such that the clamping pins engage into holes provided close to the edges of the creasing plate which are arranged opposite each other. Then, the release mechanism is returned into the rest position such that the clamping pins 62, under the effect of springs 68, pull the creasing plate 24 tight against the outer circumference of the creasing cylinder.

The clamping pins 62 are in the form of hooks so there is a slight undercut into which the creasing plate engages. This ensures that the creasing plate is mechanically held "under" the clamping pins 62 and cannot disengage axially outwardly when being clamped to the ceasing cylinder.

FIGS. 24*a* and 24*b* show the same clamping mechanism 60 which is known from the creasing cylinder.

The elastic layer 28 has a reinforcement plate 80 which is provided with holes 82 into which the clamping pins 62 engage.

The invention claimed is:

1. A creasing plate for forming a crease in a sheet, the creasing plate comprising:

a plastically deformable material including at least one creasing projection formed from a plurality of small, plastically deformed areas which merge into each other so as to form the at least one creasing projection, wherein the at least one creasing projection includes:

a first concave portion formed in a first side of the plastically deformable material to face away from the sheet, and a first convex portion corresponding with and aligned with the first concave portion and formed in a second side of the plastically deformable material opposite to the first side to face the sheet to form a first portion of the crease.

2. The creasing plate of claim 1 wherein the creasing plate has a thickness in the range of 0.2 to 0.6 mm.

3. The creasing plate of claim 1, wherein the creasing plate is made from carbon steel or stainless steel.

4. The creasing plate of claim 1, wherein the creasing projection has a height in the order of 0.6 to 1.6 mm, in particular in the order of 1.2 mm.

5. The creasing plate of claim 1, wherein the creasing projection has a radius at its apex in the order of 0.2 to 0.8 mm, in particular in the order of 0.35 to 0.55 mm.

6. The creasing plate of claim 1, wherein the creasing projection has, in a cross section, a width at its base in the order of 1 to 3 mm, preferable approximately 2 mm.

7. The creasing plate of claim 1, wherein the creasing plate is a curved plate having a first clamping area at a forward end and a second clamping area at a rearward end.

8. The creasing plate of claim 1, wherein at least one driving fillet is provided which extends around the majority of the circumference of the creasing plate.

9. The creasing plate of claim 8, wherein the driving fillet is formed by one substantially continuous fillet.

10. The creasing plate of claim 8, wherein the driving fillet is formed by a plurality of substantially discontinuous fillets.

11. The creasing plate of claim 10, wherein the plurality of substantially discontinuous fillets are aligned in the circumferential direction.

12. The creasing plate of claim 10, wherein the plurality of substantially discontinuous fillets are orientated at an angle or at more than one angle to the circumferential direction.

13. The creasing plate of claim 8, wherein the driving fillet is added onto the creasing plate.

14. The creasing plate of claim 13 wherein the driving fillet consists of cured epoxy material.

15. The creasing plate of claim 1, wherein at least two straight creasing projections are provided, the creasing projections extending terminating in a distance from each other which is less than 3 mm.

16. The creasing plate of claim 15 wherein the creasing projections extend at an angle of 15° to 90° with respect to each other.

17. The creasing plate of claim 15, wherein the creasing projections merge with the remainder of the creasing plate according to a radius which is in the order of 0.2 to 1 mm.

18. The creasing plate of claim 1, wherein the plastically deformable material consists of sheet metal.

19. The creasing plate of claim 1, wherein the plastically deformable material consists of non-metallic material such as a polymeric material.

20. The creasing plate of claim 1, wherein the at least one creasing projection further includes:

a second concave portion formed immediately adjacent to the first concave portion in the first side of the plastically deformable material to face away from the sheet, and a second convex portion corresponding with and aligned with the second concave portion and formed immediately adjacent to the first convex portion in the second side of the plastically deformable material opposite to the first side to face the sheet to form a second portion of the crease immediately adjacent to the first portion of the crease, wherein a length of the crease is greater than a width of the crease.

* * * * *